US008974324B2

(12) United States Patent
Chen

(10) Patent No.: US 8,974,324 B2
(45) Date of Patent: Mar. 10, 2015

(54) DUAL-PURPOSE BASEBALL HITTING TRAINER

(71) Applicant: Yung-Chien Chen, Taipei (TW)

(72) Inventor: Yung-Chien Chen, Taipei (TW)

( * ) Notice: Subject to any disclaimer, the term of this patent is extended or adjusted under 35 U.S.C. 154(b) by 0 days.

(21) Appl. No.: 14/023,477

(22) Filed: Sep. 11, 2013

(65) Prior Publication Data

US 2014/0296000 A1 Oct. 2, 2014

(30) Foreign Application Priority Data

Mar. 28, 2013 (TW) ..... 102205709 A

(51) Int. Cl.
*A63B 71/00* (2006.01)
*A63B 69/00* (2006.01)

(52) U.S. Cl.
CPC ..... *A63B 69/0075* (2013.01); *A63B 69/0002* (2013.01); *A63B 2069/0008* (2013.01); *A63B 2243/0004* (2013.01)
USPC ..... 473/417; 473/422; 473/451

(58) Field of Classification Search
CPC ..... A63B 69/0075; A63B 2225/093; A63B 2069/0008; A63B 69/0002; A63B 2071/026; A63B 69/00
USPC ..... 473/417, 451, 422, 453
See application file for complete search history.

(56) References Cited

U.S. PATENT DOCUMENTS

| | | | | |
|---|---|---|---|---|
| 3,874,662 | A * | 4/1975 | Harrington | 473/417 |
| 6,146,289 | A * | 11/2000 | Miller et al. | 473/417 |
| 6,398,671 | B1 * | 6/2002 | Rios | 473/417 |
| 7,204,769 | B2 * | 4/2007 | Bandimere et al. | 473/417 |
| 7,704,168 | B1 * | 4/2010 | Hochberg | 473/417 |
| 8,162,780 | B2 * | 4/2012 | Wang | 473/417 |
| 8,393,980 | B2 * | 3/2013 | Chen | 473/417 |
| 8,747,258 | B2 * | 6/2014 | Durham et al. | 473/417 |
| 2010/0056306 | A1 * | 3/2010 | Chen | 473/417 |
| 2010/0311524 | A1 * | 12/2010 | Lay | 473/417 |
| 2011/0183782 | A1 * | 7/2011 | Wang | 473/417 |
| 2011/0281671 | A1 * | 11/2011 | Chen | 473/417 |
| 2012/0165136 | A1 * | 6/2012 | Durham et al. | 473/417 |
| 2013/0109508 | A1 * | 5/2013 | Lay | 473/417 |

* cited by examiner

*Primary Examiner* — Mitra Aryanpour
(74) *Attorney, Agent, or Firm* — Leong C. Lei

(57) ABSTRACT

A baseball hitting trainer comprises a supportive cup, an upper pipe, a lower pipe, an upper sleeve, a lower sleeve, an resilient piece connected between the upper sleeve and the lower sleeve, a locking device for locking the upper sleeve with the resilient piece to the lower pipe, a base fixed to the lower sleeve, a weight block, and a fastening ferrule, wherein the lower pipe is allowed to be inserted through the central through hole of the weight block, and the fastening ferrule is fitted around the lower pipe to fasten the weight block onto the lower pipe, whereby the hitting trainer can provide two modes of operation. Under the swing mode, the weight block can be positioned at various heights by adjusting the weight block along the lower pipe to have the hitting trainer swung at various frequencies and speeds, at which a hitter wishes to practice a hitting.

4 Claims, 10 Drawing Sheets

DUAL-PURPOSE BASEBALL HITTING TRAINER

TECHNICAL FIELD OF THE INVENTION

The present invention relates to a baseball hitting trainer and, more particularly, to a dual-purpose baseball hitting trainer that can provide two modes of operation, wherein, when the trainer is operated under the swing mode, the baseball can be swung at various frequencies and speeds, at which a hitter wishes to practice a hitting.

DESCRIPTION OF THE PRIOR ART

Conventional baseball hitting trainers, such as those disclosed in U.S. Pat. Nos. 7,704,168, 6,884,185, 2,527,906, 7,303,494, 6,612,943, and 7,226,372, almost offer a static training, in which a baseball is standing still on top of a trainer for allowing a hitter to practice a hitting. However, this type of hitting trainer cannot simulate real situation of a baseball game, wherein pitches of various speeds were often encountered. Thus, there is a need for improving the conventional baseball trainers.

SUMMARY OF THE INVENTION

The primary object of the present invention is to provide a baseball hitting trainer that can be operated at various frequencies and speeds for a hitter.

To achieve the above objectives, the baseball hitting trainer may comprise a supportive cup, an upper pipe, a lower pipe telescopically connected with the upper pipe, an upper sleeve, a lower sleeve, an resilient piece connected between the upper sleeve and the lower sleeve, a locking device for locking the upper sleeve together with the resilient piece on the lower pipe, a base fixed to the lower sleeve, a tubular weight block, and a fastening ferrule, wherein the lower pipe is allowed to be inserted through the central through hole of the weight block, and the fastening ferrule can be fitted around the lower pipe to fasten the weight block onto the lower pipe, whereby the weight block can be positioned at various heights by adjusting the weight block and the fastening ferrule along the lower pipe to allow the trainer to be swung at various frequencies and speeds, at which a hitter wishes to practice hitting an ball.

The secondary object of the present invention is to provide a baseball hitting trainer that can be operated under a swing mode or a non-swing mode.

To achieve the above object, the locking device may include an engagement bolt and C-shaped nut, wherein the engagement bolt has a head portion, a threaded stem having a dimension less than the head portion, and a bottom portion that can be fastened to a top end of the upper sleeve that connects a top end of the resilient piece, and the C-shaped nut is provided with teeth at its outer surface and threads at its inner surface, wherein the outer surface of the C-shaped nut has a diameter substantially the same as the inside diameter of the lower pipe to allow the C-shaped nut to be engaged in the lower pipe, and the C-shaped nut can be threadably engaged with the threaded stem of the engagement bolt, whereby the resilient piece can be positioned partially within the lower pipe to allow the resilient piece to extend outwardly from the lower pipe to provide the trainer with swing training capability or positioning the resilient piece completely within the lower pipe so that the swing capability of the hitting trainer is disabled.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
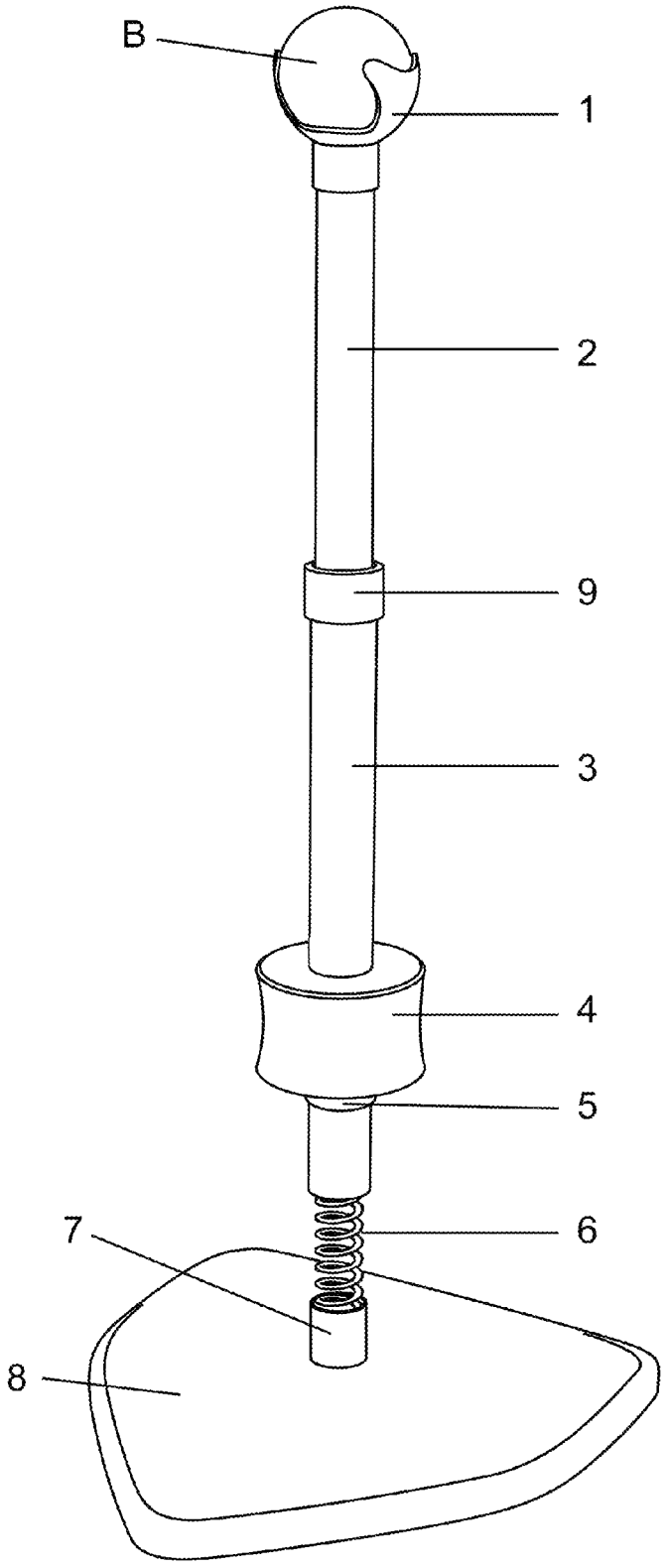
FIG. 1 shows a 3-dimensional view of a first embodiment of the present invention.
Figure 2:
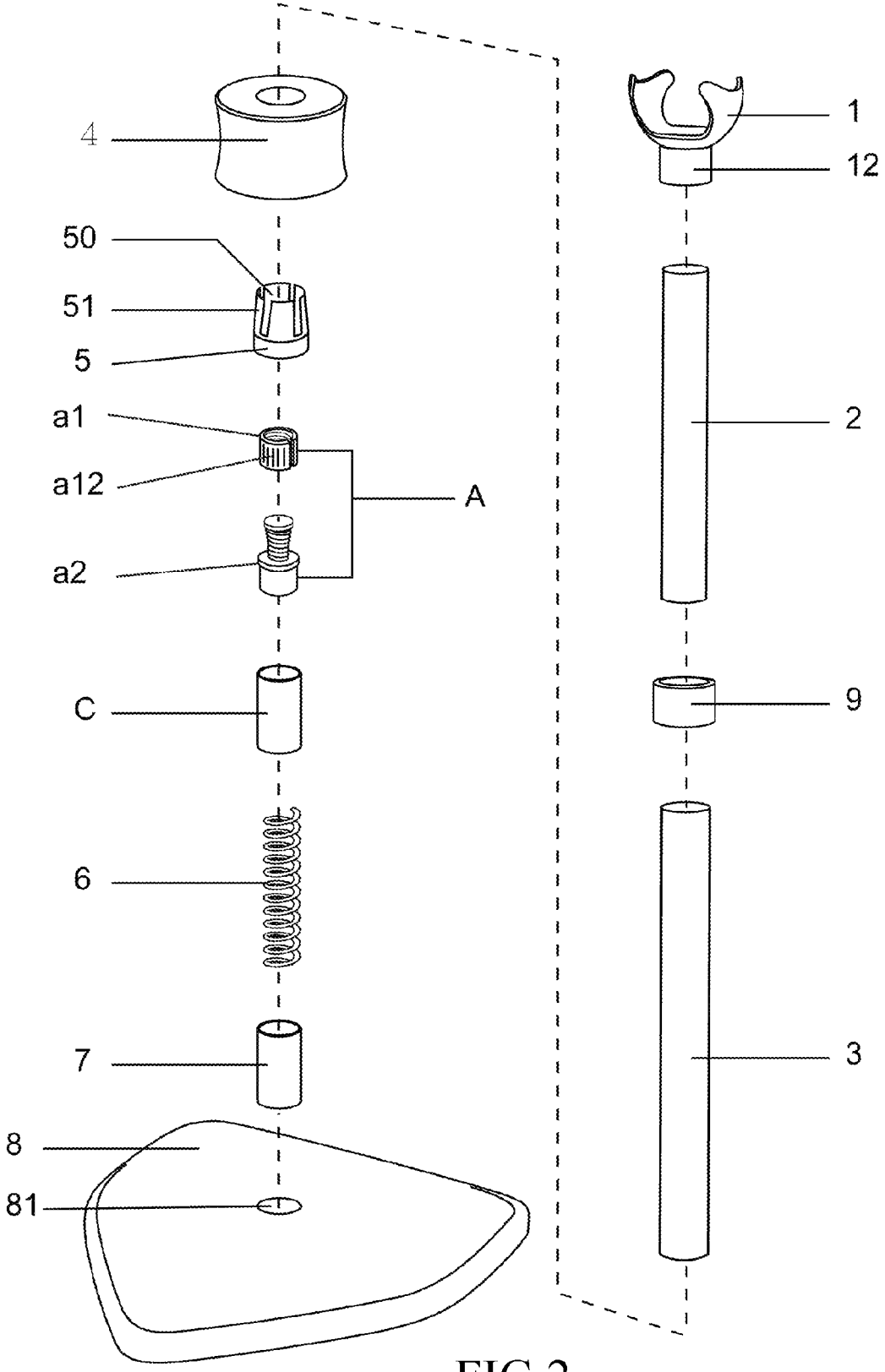
FIG. 2 shows an exploded view of the first embodiment of the present invention.
Figure 3:
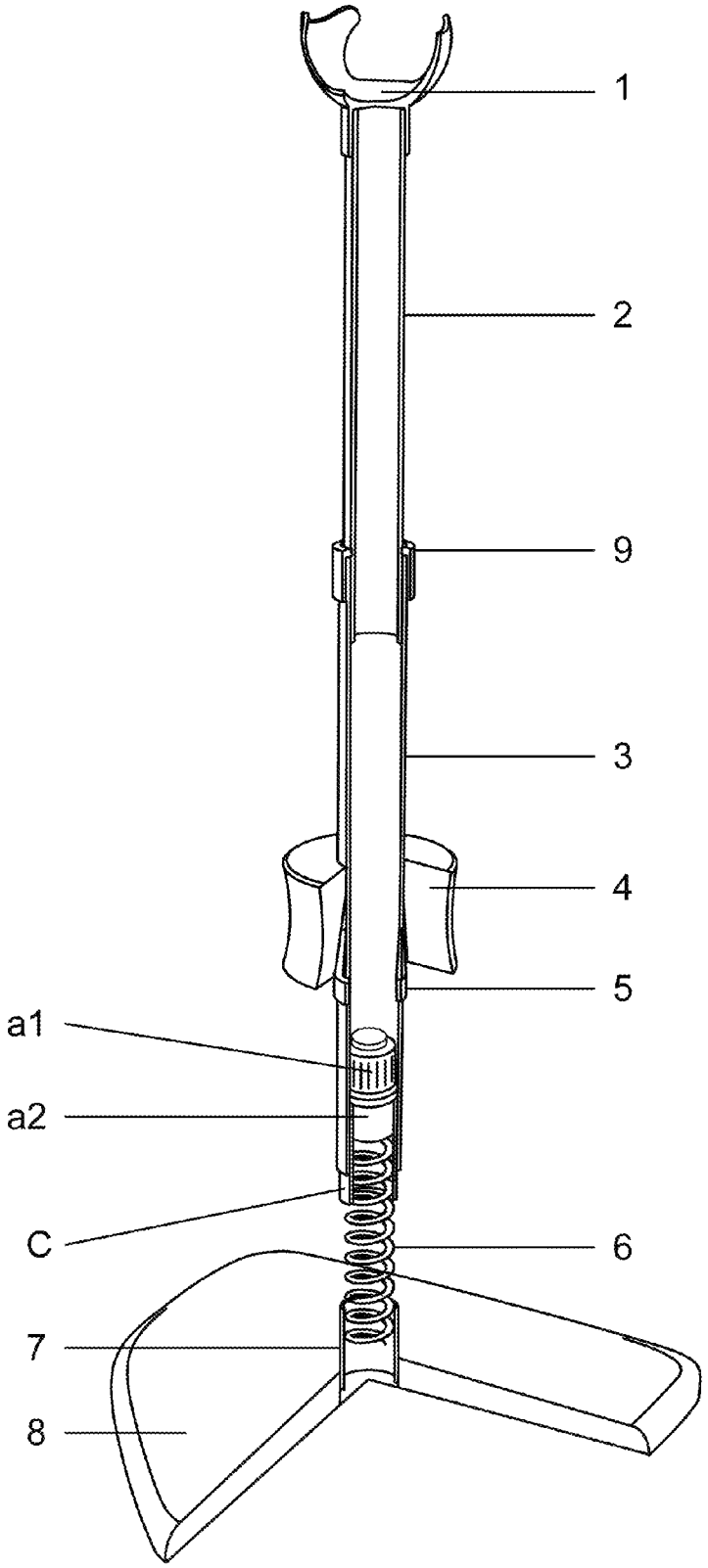
FIG. 3 shows a 3-dimensional sectional view of the first embodiment of the present invention.
Figure 4:
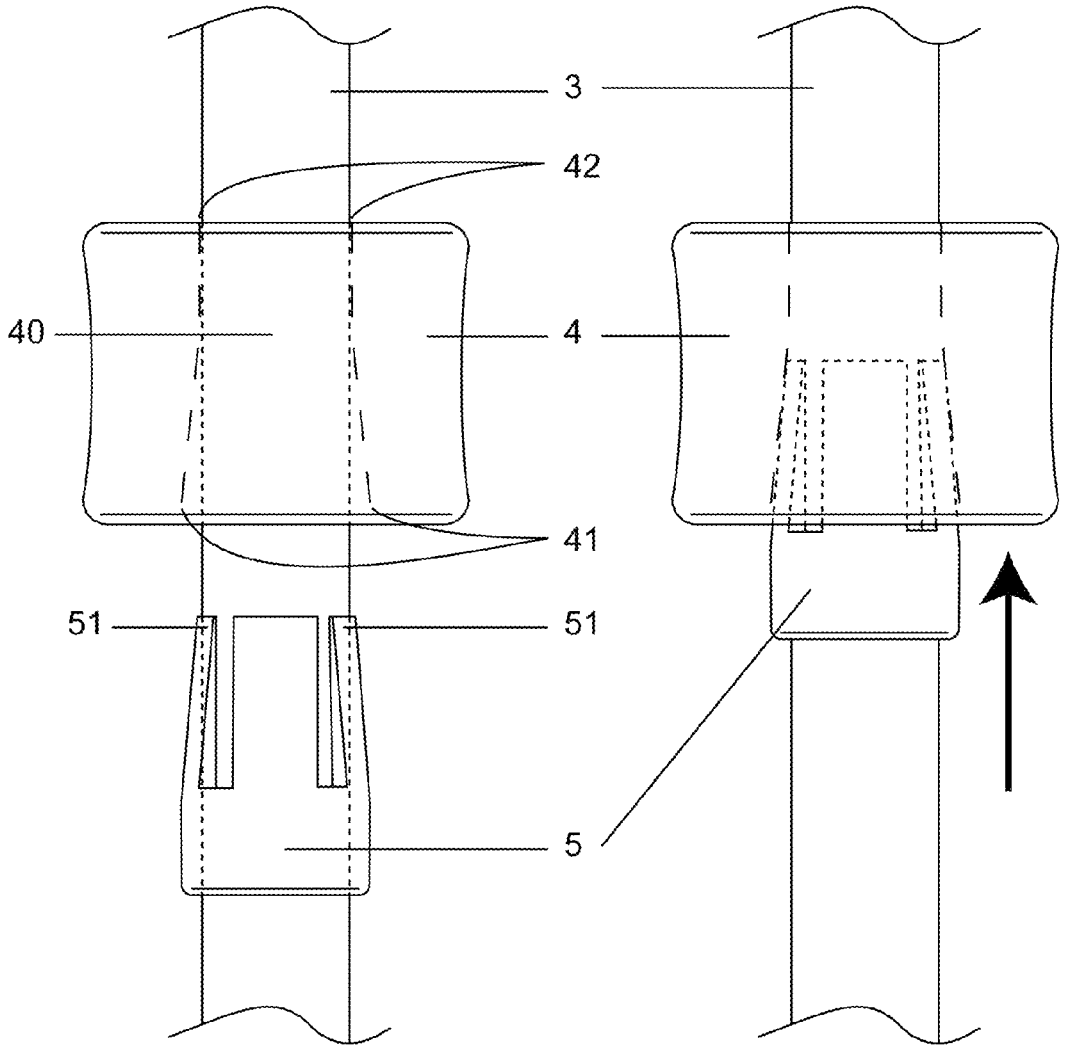
FIG. 4 shows a schematic view of the weight block and fastening ferrule used in the first embodiment of the present invention.
Figure 5:
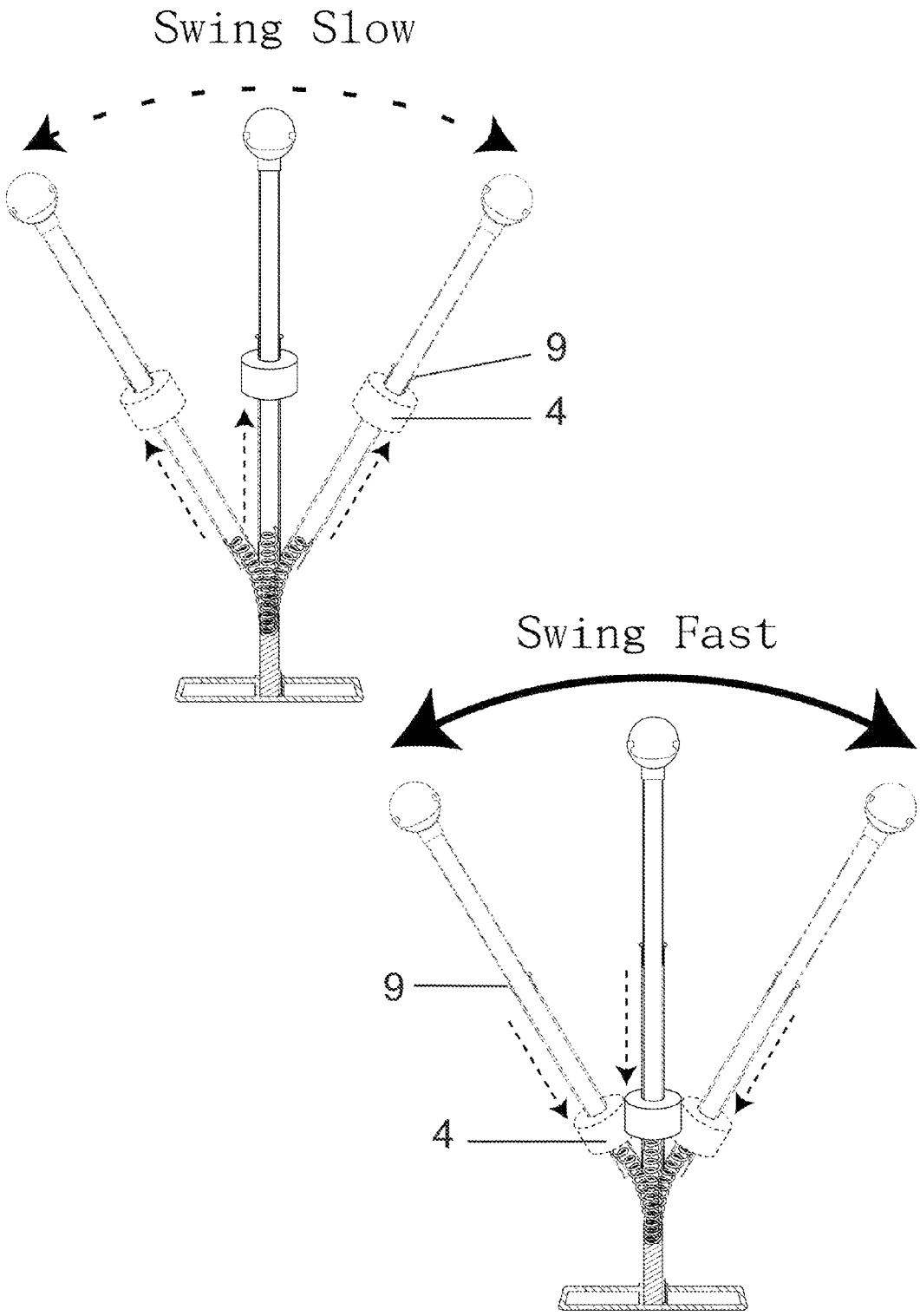
FIG. 5 shows a working view of the first embodiment of the present invention, which illustrates that the swing frequency and the speed can be changed by adjusting the height of the tubular weight block.
Figure 6:
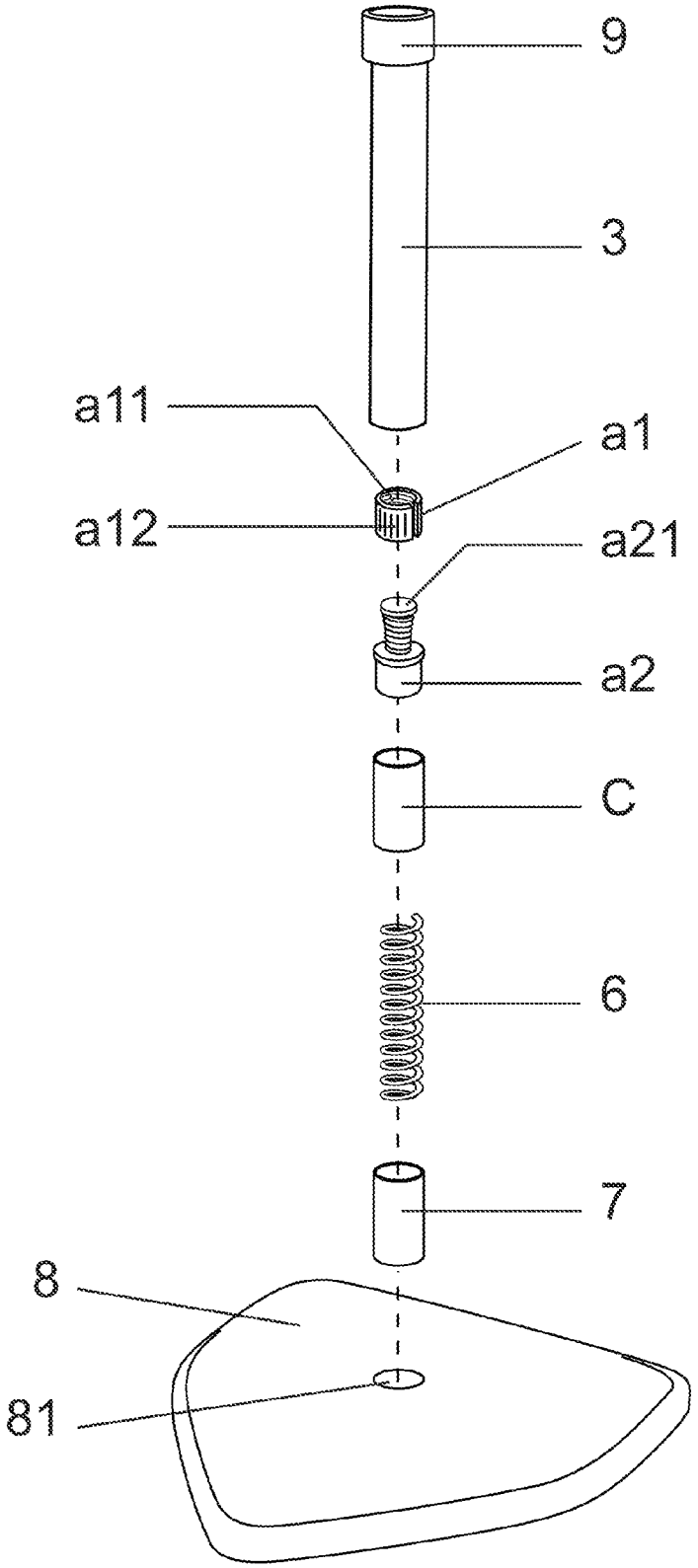
FIG. 6 shows an exploded view of the locking device used in the first embodiment of the present invention.

FIGS. 1 through 6 show one embodiment, concerning a dual-purpose baseball hitting trainer, of the present invention, which generally comprises a supportive cup (1), an upper pipe (2), a lower pipe (3) telescopically connected with the upper pipe (2), a tubular weight block (4), a fastening ferrule (5), an upper sleeve (C), a lower sleeve (7), an resilient piece (6) connected between the upper sleeve (C) and the lower sleeve (7), a locking device (A) for locking the upper sleeve (C) together with the resilient piece (6) to the lower pipe (3), a base (8) fixed to the lower sleeve (7), and a stop ring (9) provided at a top end of the lower pipe (3). The supportive cup (1), being made of flexible material for holding a baseball (B), is provided with a neck portion (12), which can be mounted on a top end of the upper pipe (2). The tubular weight block (4), having a predetermined weight and defining a central through hole (40) therein, is provided for the lower pipe (3). The central through hole (40), being shaped like a cone, has an upper opening (42) and a lower opening (41), wherein the upper opening (42) has a dimension substantially the same as the outside diameter of the lower pipe (3), and the lower opening (41) has a dimension greater than the upper opening (42). The lower pipe (3) can be inserted through the central through hole (40) of the weight block (4). The fastening ferrule (5) defines a central bore (50) and is provided with a plurality of flexible strips (51), which extends upwardly from its main body and inclines inwardly. The fastening ferrule (5) can be fitted around the lower pipe (3) and inserted into the lower opening (41) of the central through hole (40) of the weight block (4). By inserting the flexible strips (51) into the lower opening (41) of the weight block (4), the weight block (4) can be fastened onto the lower pipe (3). As such, the weight block (4) can be positioned at various heights by adjusting the weight block (4) and the fastening ferrule (5) along the lower pipe (3). The locking device (A) includes an engagement bolt (a2) and C-shaped nut (a1). The engagement bolt (a2) has a head portion, a threaded steam having a dimension less than the head portion, and a bottom portion that can be fastened to a top end of the upper sleeve (C) that connects a top end of the resilient piece (6). The C-shaped nut (a1) is provided with teeth (a12) at its outer surface and threads at its inner surface. The outer surface of the C-shaped nut (a1) has a diameter substantially the same as the inside diameter of the lower pipe (3) to allow the C-shaped nut (a1) to be engaged in the lower pipe (3). The C-shaped nut (a1) can be threadably engaged with the threaded steam of the engagement bolt (a2). The bottom portion of the engagement bolt (a2) of the locking device (A) can be inserted and fixed into the top end of the resilient piece (6). The head portion of the engagement bolt (a2) of the locking device (A) is slightly larger than the inner hole of the C-shaped nut (a1), so that the C-shaped nut (a1) can be engaged with the head portion of the engagement bolt (a2) of the locking device (A) without falling down. The resilient piece (6) can be a coil spring. The top end of the resilient piece (6) can be inserted and fixed into the bottom end of the upper sleeve (C). In use, the C-shaped nut (a1), being combined with the engagement bolt (a2) that connects the upper sleeve (C), can be inserted into the lower pipe (3) to allow the teeth (a12) of the C-shaped nut (a1) to engage with the inner surface of the lower pipe (3). When the lower pipe (3) is rotated in a direction, the C-shaped nut (a1) moves toward the head portion of the engagement bolt (a2), and thus the head portion can force the C-shaped nut (a1) to expand, thereby increasing the friction between the nut and the inner surface of the lower pipe (3), which allows the locking device (A) to be firmly locked with the lower pipe (3). On the other hand, for releasing the C-shaped nut (a1) and the engagement bolt (a2) from the lower pipe (3), the lower pipe (3) can be rotated in a reverse direction to cause the C-shaped nut (a1) to move away from the head portion of the engagement bolt (a2), so that the nut can return to its original size to reduce the friction between the nut and the inner surface of the lower pipe (3), thereby releasing the nut and the bolt. A bottom end of the resilient piece (6) can be fixed to a top end of the lower sleeve (7). The base (8), being in the shape of a home plate, defines a central fixing hole (81) for holding a bottom end of the lower sleeve (7). The stop ring (9) is provided at the top end of the lower pipe (3), to which the upper pipe (2) can be connected, for limiting the maximum height that the weight block (4) can be positioned.

Figure 7:
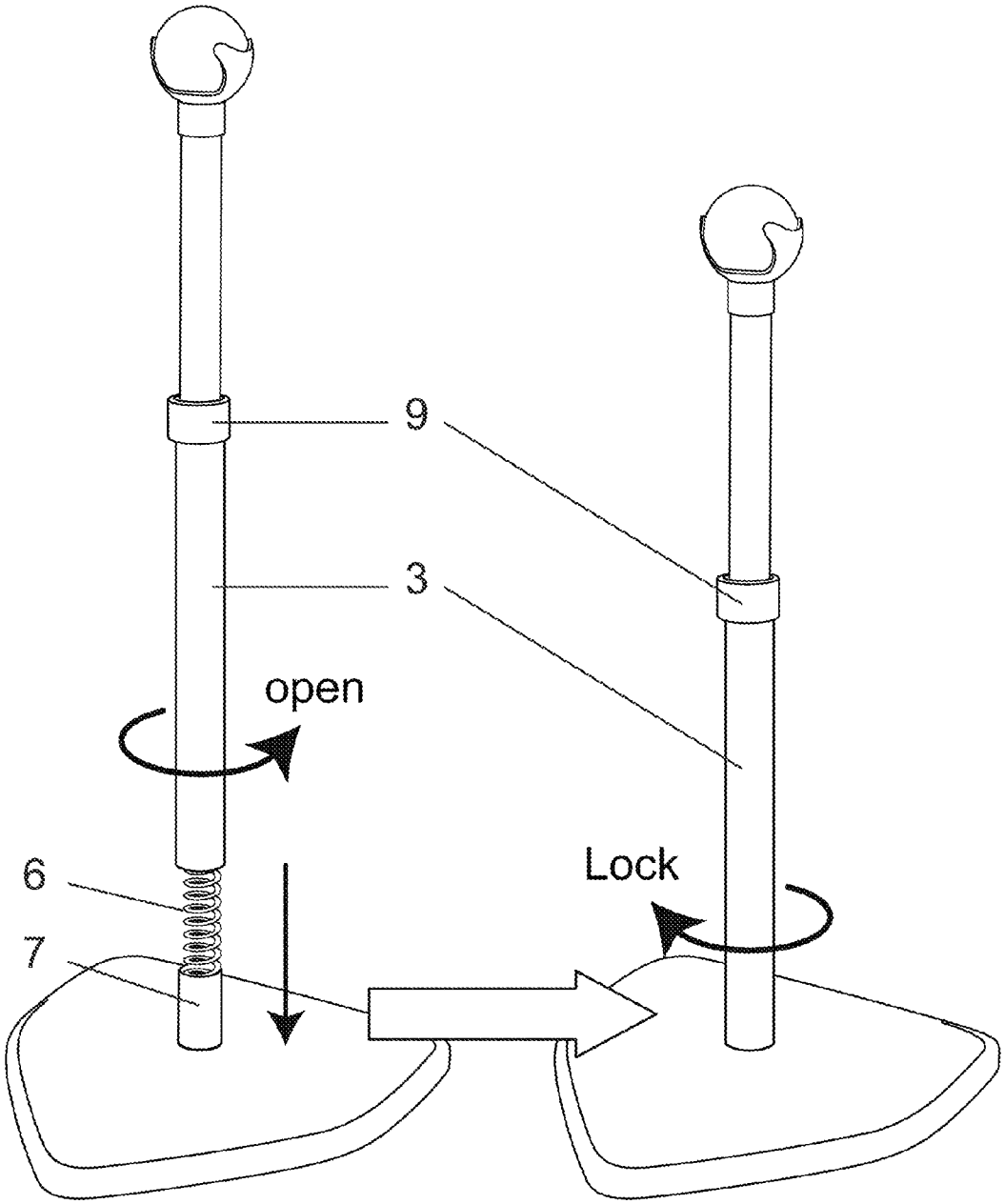
FIG. 7 shows a first embodiment of the present invention, which employs an external sleeve instead of the locking device.
Figure 8:
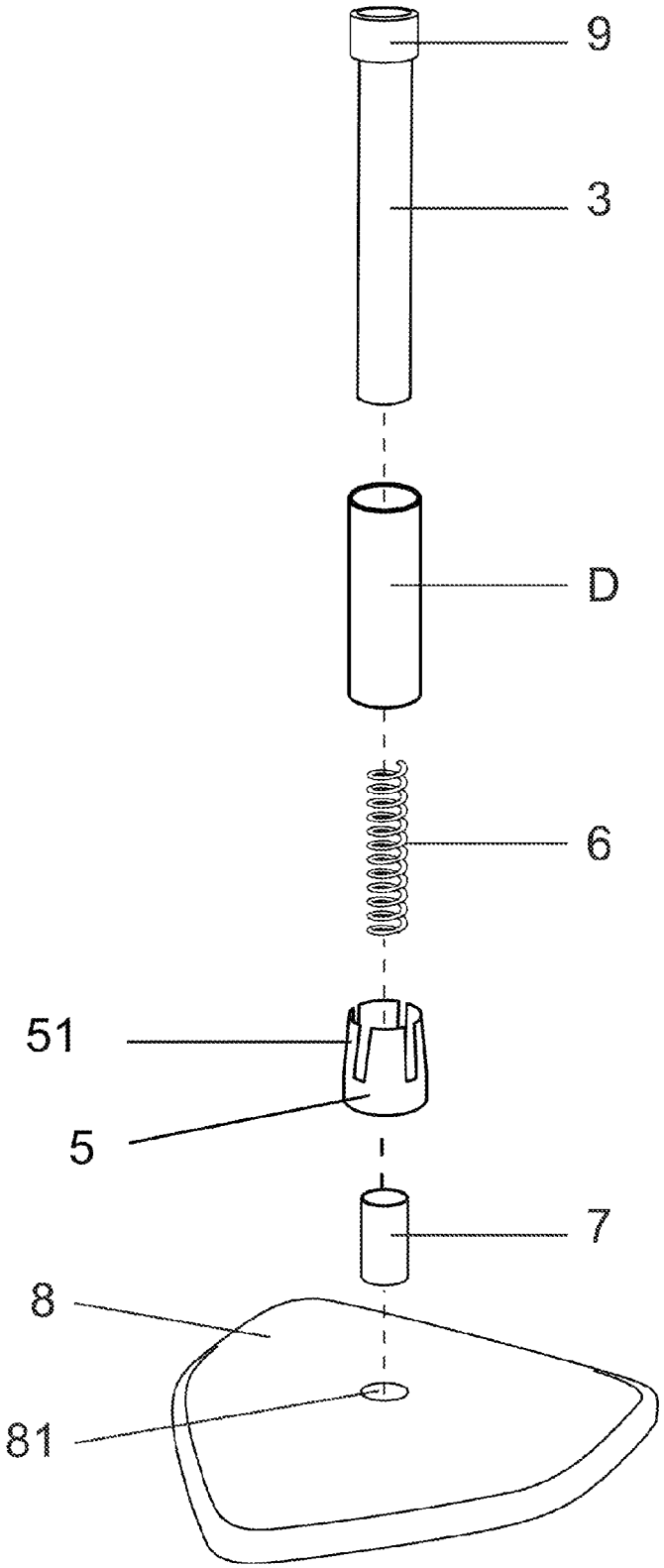
FIG. 8 shows an exploded view of the second embodiment of the present invention, which illustrates that the embodiment can be converted into a non-swing mode of operation.
Figure 9:
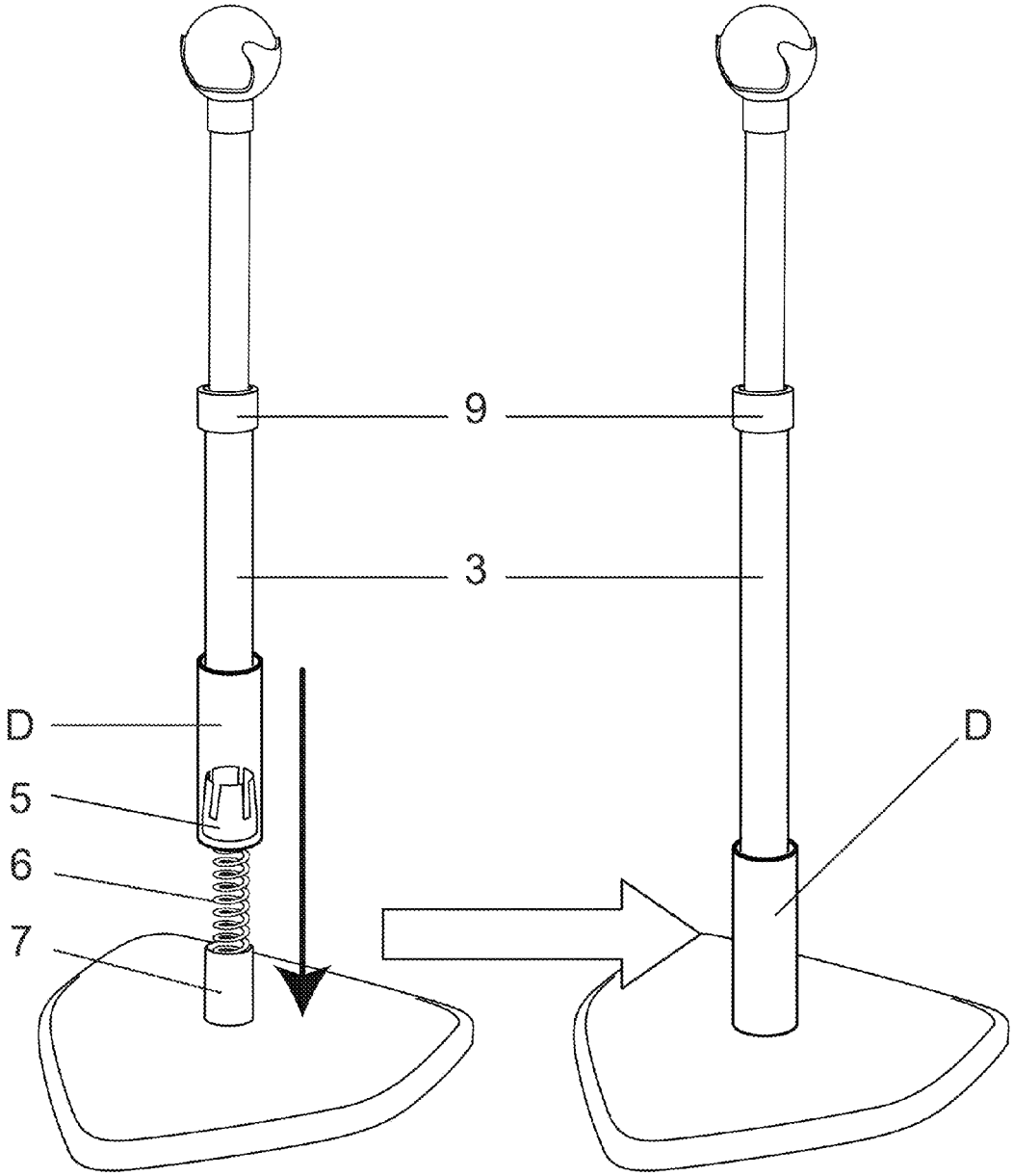
FIG. 9 shows a working view of the second embodiment of the present invention, which illustrates that the embodiment can be converted into a non-swing mode of operation.

In the present invention, the resilient piece (6) can be formed integrally with the lower sleeve (7). With the resilient piece (6) connected between the upper sleeve (C) and the lower sleeve (7), the baseball (B) can be swung on top of the supportive cup (1) of the hitting trainer in 2-D or 3-D path, wherein the stop ring (9) can be used to adjust the extension length of the upper pipe (2), and further with a height adjustment of the weight block (4), the swing frequency and speed of the baseball can be adjusted to various values, among which a hitter may select one that he or she wishes to practice hitting the baseball (B). The hitting trainer can provide two modes of operation, including swing mode and non-swing mode. In the swing mode of operation, as shown in FIG. 7, the resilient piece (6) can be partially within the lower pipe (3) to allow the resilient piece (6) to be exposed out of the lower pipe (3) to provide the hitting trainer with swing capability. When the non-swing mode of operation is required, the hitter can adjust the position of the locking device (A) by first rotating the lower pipe (3) in a direction for releasing the locking device (A) and then moving the lower pipe (3) downwardly to fit over the lower sleeve (7) and then rotating the lower pipe (3) in a reverse direction so that the locking device (A) locks the lower pipe (3) in place. When the resilient piece (6) is completely within the lower pipe (3), the swing capability of the hitting trainer can be disabled. The hitter may choose either mode to proceed with swing training FIGS. 8 and 9 show another embodiment of the present invention, wherein the locking device (A) and the upper sleeve (C) are replaced by an external sleeve (D), which has an inside diameter slightly greater than the outside diameters of the lower pipe (3), the resilient piece (6), and the lower sleeve (7). The top end of the resilient piece (6) is directly connected to the bottom end of the lower pipe (3), and the other end of the resilient piece (6) is inserted through the external sleeve (D) to connect with the top end of the lower sleeve (7). As such, when the external sleeve (D) is not engaged with the lower sleeve (7), the resilient piece (6) can be exposed out of the lower pipe (3) to provide the hitting trainer with swing capability, wherein the fastening ferrule (5) that is received in the lower opening of the external sleeve (D) is fixed to the outer wall of the lower pipe (3) at a suitable location by means of the flexible strips (51); when the external sleeve (D) is moved downwardly to engage with the lower sleeve (7), the piece (6) can be totally within the external sleeve (7) to disable the swing capability of the hitting trainer, wherein with the external sleeve (D) released, the flexible strips (51) of the fastening ferrule (5) are caused by the gravity thereof to slide down. The hitter may choose either mode to proceed with a hitting training. The external sleeve (D) is made of a flexible material and can be for example a rubber tube having a slightly higher stiffness for directly fitting to the lower pipe (3) to enable vertical movement and positioning between the lower pipe (3) and the resilient pipe (6) and the external sleeve (7) without the use of the fastening ferrule to achieve positioning. In other words, the external sleeve (D) can be used solely.

Figure 10:
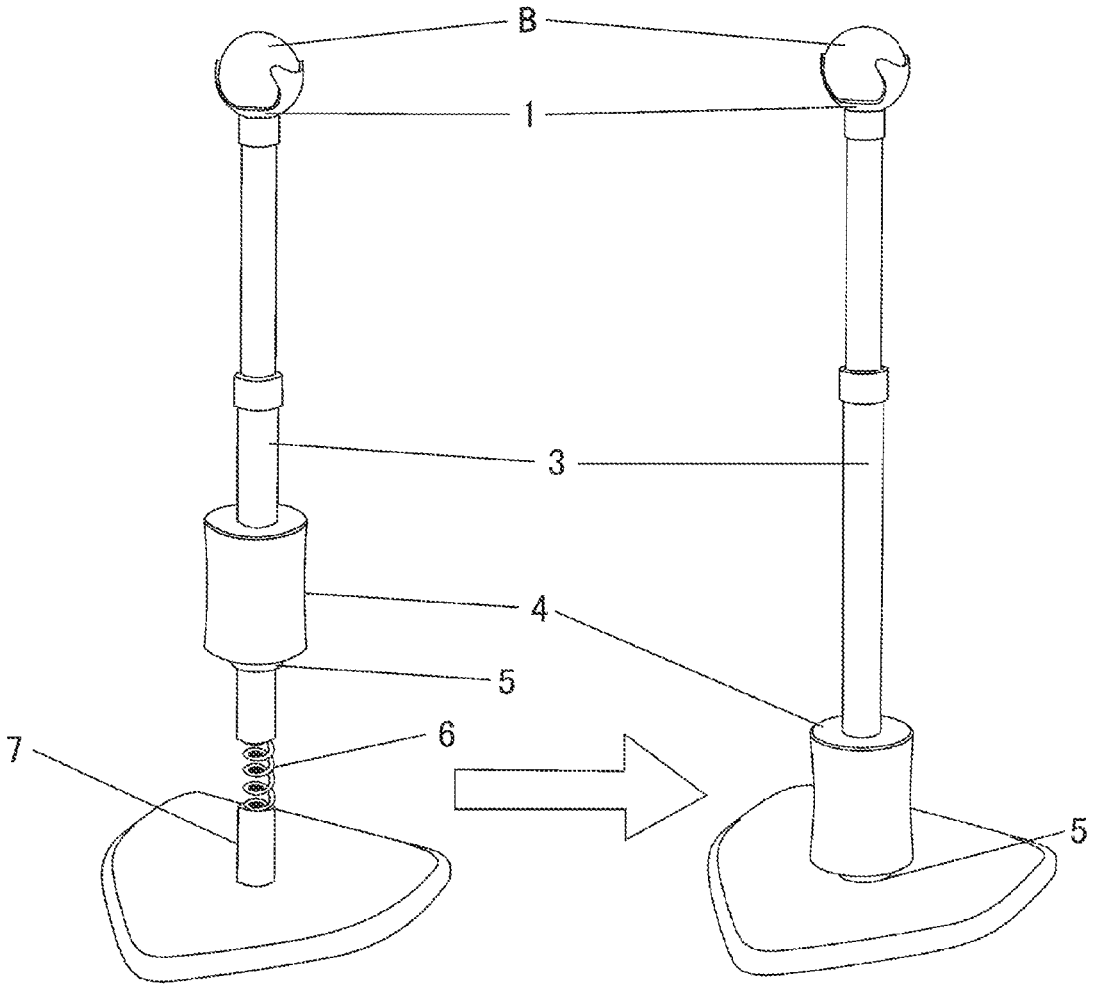
FIG. 10 is a schematic view showing a tubular weight block according to a further embodiment of the present invention moving downward to completely receive an elastic piece therein.

In a further embodiment, as illustrated in FIG. 10, the external sleeve (D) can be replaced by a tubular weight block (4) that defines a central through hole (40) and the same effect of moving downward to completely receive the resilient piece (6) therein and moving upward to allow the flexible strips (51) of the fastening ferrule (5) to fix to a suitable location of the outer wall of the lower pipe (3) can be provided, for changing the vertical location of the gravity center to thereby generate different swing frequency and speed.

Although the present invention has been described with a certain degree of particularity, it is understood that the present disclosure is made by way of example only and the combination and arrangement of parts may be resorted to without departing from the spirit and scope of the invention hereinafter claimed.

I claim:

1. In a ball hitting trainer of the type including a supportive cup for holding a ball, an upper pipe, a lower pipe telescopically connected with the upper pipe, an upper sleeve, a lower sleeve, a resilient piece connected between the upper sleeve and the lower sleeve, a locking device for locking the upper sleeve with the resilient piece on the lower pipe, and a base attached to the lower sleeve, wherein the improvement comprises:

a weight block defining a tubular central through hole, the weight block slidably positioned on the lower pipe, wherein the central through hole is cone shaped and includes an upper opening and a lower opening, the upper opening having a dimension substantially the same as the outside diameter of the lower pipe, and the lower opening having a dimension greater than the upper opening, wherein the lower pipe is slidably received in the central through hole of the weight block; and a fastening ferrule, having a tubular configuration including a central bore that is slidably positioned on the lower pipe and further comprising a plurality of flexible pieces extending therefrom, the flexible pieces slidably received in the lower opening of the central through hole of the weight block, thereby fastening the weight block to the lower pipe;

whereby the tubular weight block is adjustably positioned at various heights by adjusting the weight block and the fastening ferrule along the length of the lower pipe to allow the hitting trainer to be swung at various frequencies and speeds, at which a hitter wishes to practice a hitting.

2. The ball hitting trainer of claim 1, wherein the locking device includes an engagement bolt and a C-shaped nut, wherein the engagement bolt has a head portion, a threaded stem having a dimension less than the head portion, and a bottom portion that can be fastened to a top end of the upper sleeve that connects to a top end of the resilient piece, and the C-shaped nut is provided with teeth on an outer surface and threads on an inner surface, wherein the outer surface of the C-shaped nut has a diameter substantially the same as an inside diameter of the lower pipe to allow the C-shaped nut to be engaged in the lower pipe, and the C-shaped nut can be threadably engaged with the threaded stem of the engagement bolt, whereby the resilient piece is adjustably positioned on the lower pipe to allow the resilient piece to flex outwardly from the lower pipe permitting the hitting trainer two modes of operation 1) swing mode or 2) non-swing mode in which the resilient piece is positioned within the lower pipe.

3. The ball hitting trainer of claim 2, wherein the locking device and the upper sleeve are replaced by an external sleeve, a top end of the resilient piece is directly connected to the lower pipe, and the lower end of the resilient piece is inserted through the external sleeve in order to connect with a top end of the lower sleeve, whereby, when the external sleeve is not engaged with the lower sleeve, the resilient piece extends outwardly from the lower pipe to position the hitting trainer in the swing mode; and when the external sleeve is move downwardly to engaged with the lower sleeve, the resilient piece extends within the lower pipe to position the hitting trainer in the non-swing mode.

4. The ball hitting trainer of claim 1, wherein the tubular weight block is an external sleeve having a central bore and movable downwardly on the lower pipe towards the lower sleeve for receiving the resilient piece therein.

* * * * *